US006230762B1

(12) United States Patent
Baudin et al.

(10) Patent No.: US 6,230,762 B1
(45) Date of Patent: May 15, 2001

(54) DISPENSER FOR DISPENSING A PRODUCT AND A METHOD OF MAKING A DISPENSER

(75) Inventors: Gilles Baudin, Domont; Pierre-André Lasserre, Coubron, both of (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/533,603

(22) Filed: Mar. 23, 2000

(30) Foreign Application Priority Data

Mar. 24, 1999 (FR) ..... 99 03676

(51) Int. Cl.[7] ..... B65B 1/04

(52) U.S. Cl. ..... 141/20; 141/3; 222/321.7; 222/386

(58) Field of Search ..... 222/321.7, 321.8, 222/321.9, 386, 386.5; 141/20, 3, 27, 1, 2, 18; 29/235, 888, 888.02, 888.04, 888.044, 888.047

(56) References Cited

U.S. PATENT DOCUMENTS 3,117,404 1/1964 Miles .
3,128,922 4/1964 Kuster .
3,896,602 * 7/1975 Petterson ..... 53/36
4,045,860 * 9/1977 Winckler ..... 29/451
4,789,012 * 12/1988 Hart ..... 141/18
5,988,453 11/1999 de Laforcade et al. .

FOREIGN PATENT DOCUMENTS 32 47 569 6/1983 (DE) .
0 030 990 7/1981 (EP) .
2 244 678 4/1975 (FR) .
2 748 460 11/1997 (FR) .

* cited by examiner

*Primary Examiner*—Steven O. Douglas
(74) *Attorney, Agent, or Firm*—Finnegan, Henderson, Farabow, Garrett & Dunner, L.L.P.

(57) ABSTRACT

The present invention relates to a dispenser for storing a product, particularly a cosmetic product, and dispensing the product. The dispenser includes a container containing the product and having a free edge which delimits an opening in which is mounted a dispensing member. The dispensing member may be, for example, a manually actuated pump or a valve. A piston is mounted so as to move axially inside the container and to separate in leakproof fashion a first volume, adjacent to the dispensing member and containing the product, from a second volume adjacent to the first, the piston being formed by molding directly inside the container.

52 Claims, 5 Drawing Sheets

DISPENSER FOR DISPENSING A PRODUCT AND A METHOD OF MAKING A DISPENSER

The present invention relates to an assembly for packaging a product, particularly a cosmetic product, and dispensing it under pressure, of the type using a piston. The products which the present invention dispenses may be of liquid-to-pasty consistency. They may, for example, be a spray or a lacquer, particularly for hair styling, or a milk, or a gel, or a cream or a paste.

Pistons may be used in aerosol devices in which the product is pressurized by means of a propellant, for example a compressed or liquefied gas kept isolated from the product by the piston. Pistons may also be used in pump mechanisms which operate without an air intake, in which case the function of the piston is to follow the level of product inside the container so that, regardless of how much the device has been used, the product always occupies all the available volume.

In the field of aerosols, it is known to produce devices in the form of a container containing the product and having a free edge which delimits an opening in which a valve is mounted, a piston being mounted so as to move axially inside the container. The piston separates in leakproof fashion a first volume, adjacent to the dispensing member and containing the product, from a second volume adjacent to a bottom of the container and containing the propellant. The bottom of the container is closed and includes means, for example in the form of a valve or some other equivalent member, to allow the propellent gas to be introduced into the second volume. The container may for example be made of metal.

Dispensers fitted with an "airless pump" are commonly used in fields such as cosmetics. As used herein, the term "airless pump" refers to a pump that provides pumping of a substance from a container in essentially a single direction without permitting reverse (intake) flow of air via the pump. That is, as product is pumped from the container, the pumped product is not replaced with a corresponding volume of air through the pump. In addition to preventing reverse intake flow of "air" via the pump, an "airless pump" typically does not allow intake of any other substances to replace the volume of product pumped out of the container. For example, an "airless pump" could include a one-way valve, such as a check valve.

There are several problems associated with producing and using such devices. First of all, the leakproof seal achieved between the piston and the interior surface of the container, particularly in the case of metal containers, is often insufficient. This problem is all the more critical when the can, made of metal, has a longitudinal weld line which produces a thickening that is detrimental to forming a leakproof seal. Furthermore, the piston is molded in an auxiliary mold which has a serious adverse effect on the cost of manufacture of such a device. Finally, in the case of a container which narrows near its opening, it is necessary to introduce the piston into the container before the narrowing is formed, and this greatly complicates the manufacturing process.

In the case of an airless pump device, using a follower piston, there is the same problem of cost associated with the use of an auxiliary mold for producing the piston. There is also the problem associated with making the contact between the peripheral surface of the piston and the interior surface of the container leakproof.

Therefore, one of the objects of the present invention is to provide a dispenser for storing a product under pressure, for example a cosmetic product, and for dispensing it using a piston, which also completely or partially solves the problems discussed hereinabove with reference to the conventional devices.

A particular object of the invention is to provide a dispenser of the piston type which offers a better leakproof seal in comparison to conventional devices.

Another object of the invention is to provide a dispenser of the piston type which is less expensive to manufacture in comparison to conventional devices.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes a dispenser. The dispenser comprises a container containing the product and having a free edge which delimits an opening in which is mounted a dispensing member. The dispensing member may preferably be a manually actuated pump or a valve. A piston is mounted so as to move axially inside the container and to separate in leakproof fashion a first volume, adjacent to the dispensing member and containing the product, from a second volume adjacent to the first, the piston being formed by molding directly inside the container.

As the piston is molded directly inside the container, it is possible to obtain a piston whose peripheral surface perfectly matches the profile formed by the interior surface of the container, and is thus leakproof, regardless of the manufacturing tolerances of the container. This improvement is most particularly marked in the case of aerosol cans formed of a metal sheet formed into the shape of a cylinder and welded along a longitudinal weld zone. In such a case it was particularly difficult, with conventional pistons, to obtain good leakproof contact particularly in the region of the weld zone. Furthermore, the use of an auxiliary mold for producing the piston is dispensed with, which plays a part in appreciably reducing the cost of producing such a packaging assembly. Finally, in the case of an aerosol which has a narrowing near its opening, it is possible to position the piston inside the container even after the narrowed opening has been formed.

In addition to the numerous advantages stated hereinabove, there is also the possibility, for example in the case of airless pump devices, of producing containers which may have any cross section, for example oval, square, triangular or any other polygon-shaped cross section.

In a first embodiment of the present invention, the dispensing member is preferably a valve, the bottom of the container is closed, the second volume contains a propellant, for example a compressed or liquefied gas, capable of pressurizing the product via the piston, and the closed bottom includes a filling element, for example, a valve or its equivalent, capable of allowing the propellant to be introduced into the second volume. The valve may be of any known type. This may, for example, be a valve that has to be depressed or a valve that has to be pivoted. As a preference, the propellant is compressed air or isobutane. The valve or equivalent may be any type of one-way valve, particularly of the ball type.

However, as a preference, the filling element for allowing the propellent gas to be introduced includes a self-sealing plug, particularly one made of an elastomeric material, which can be pierced by a hollow needle communicating with a source of gas, and which can close again in leakproof fashion when the needle is withdrawn from the plug. In this last scenario, on a face which faces towards the bottom, the piston may include a reinforcing element capable of forming a screen, at least opposite the filling element allowing the propellant to be introduced, so as to prevent the needle from being pushed into the piston. This feature is most particularly advantageous when the propellant is introduced into the corresponding volume of the container with the piston arranged at the bottom of the container. Furthermore, a reinforcing element of this kind which is preferably anchored in the piston, may play a part in stiffening the piston structure.

The body of the container may be made of thermoplastic or of metal, particularly tin plate or aluminium.

In the case of an aerosol device, the bottom of the container may be closed by an element which forms a single piece with the body of the container, or by an attached element.

In an alternative embodiment, the dispensing member may be an airless pump, the piston being able to move axially inside the container so as to form a moving bottom for the first volume capable, as dispensing progresses, of accompanying the product upward inside the first volume. The bottom of the container may be open or closed off by an element which has at least one orifice for taking air up into the second volume. In the case of a container with an open bottom, it is possible to envisage temporarily closing it using an attached element which is removed after the piston has been molded or by an appropriate surface on which the container is set down while the piston is being molded.

The piston may be made of a material introduced into the container in liquid form and capable, particularly by in-situ polymerization or cooling, vulcanization or crosslinking, of solidifying and forming an elastically deformable structure in leakproof contact with an interior lateral surface of the container. To this end, the material forming the piston must be compatible with (i) the material forming the body of the container, (ii) the product that is to be packaged, and (iii) the propellant. Such a material must also be impermeable to the product packaged and to the propellant. Furthermore, it must not stick to the surfaces of the container with which it is placed in contact. It must be such that, on setting, the material does not shrink in such a way as to destroy the leakproof seal established by its peripheral contact with the interior surface of the container. The setting of the material that forms the piston may occur at ambient temperature, or at a higher temperature if necessary.

Advantageously, the material is, for example, a silicone, which may be introduced into the container in the presence of an appropriate catalyst. More specifically, use is preferably made of a silicone of the type used for taking dental impressions. By way of example, mention may be made of the materials sold under the trade name PLASTIFORM® KR and KS, by the company RIVELEC. Such silicones are vinyl-polydimethyl-siloxanes. Once solidified, the material is of soft to semi-soft consistency and has a hardness of from 35 shore A to 70 shore A. The setting or polymerization time may be of the order of 5 minutes to 10 minutes and may be shortened appreciably by using special catalysts.

In the case of an aerosol, the height over which the piston presses against the interior walls of the container to form a leakproof seal may be from 5 mm to 20 mm. As a preference, the ratio between the height over which the piston presses in leakproof fashion against the interior walls of the container and the diameter of the piston at the point where it presses in leakproof fashion, is greater than or equal to 0.3 and is preferably from 0.5 to 1. When the piston contains an element capable of stiffening it, this ratio is lower than or equal to 1, and is preferably from 0.3 to 0.6. In the case of a piston of non-circular cross section, the diameter of the piston is understood as meaning the diameter of the circle in which it is inscribed.

Advantageously, the dispensing member is surmounted by a dispensing head including at least one surface for actuating the dispensing member and at least one dispensing orifice. Also as a preference, the dispensing head is surmounted by a removable cap.

According to another aspect of the invention, a method for arranging a piston inside an assembly for packaging a product, for example a cosmetic product, and dispensing it under pressure, formed of a container having a free edge which delimits an opening on which is mounted a dispensing member, for example a manually actuated pump or a valve, the piston being intended to move axially inside the container and to separate in leakproof fashion a first volume, adjacent to the dispensing member and containing the product, from a second volume adjacent to the bottom of the container, is provided. The method includes molding the piston directly inside the container.

According to one embodiment, the bottom of the container is closed, the material used to produce the piston being introduced into the container in liquid form via the opening before the dispensing member is mounted. It is therefore possible to allow the material to set in the bottom of the container. Particularly in the case of an airless pump whose bottom is pierced with an air intake orifice, or in the case of an aerosol device filled with propellant such as compressed or liquefied gas, via the bottom of the container using a needle passed through an elastomeric plug, it is possible to provide an element anchored in the piston while the piston is molded, which is able to prevent the material for molding the piston from flowing into the air intake orifice or to prevent the needle from being pushed into the piston. Such an element is introduced into the bottom of the container before the composition intended to form the piston is poured in.

Alternatively, before the material forming the piston sets, for example by polymerization, and after the dispensing member has been mounted in place, the container is inverted so as to cause the piston to form away from the bottom of the container. Thus, on a face which faces towards the opening of the container, the piston exhibits a profile which corresponds precisely to the profile formed by the dispensing member inside the container, and this allows the container to be completely emptied.

For similar reasons, when the bottom of the container is open, the material used to produce the piston may be introduced into the container in liquid form via the open bottom of the container after the dispensing member has been mounted in place. After the material intended to form the piston has been introduced, the open bottom of the container may be closed off using an attached element.

When the piston is formed at that end of the container which is adjacent to the dispensing member, the inlet orifice of the dispensing member, arranged inside the container, may be closed off by a removable element comprising structure capable, when the material forming the piston sets, of anchoring into this piston in such a way as to secure the removable shut-off element to the piston. Next, when the product is introduced into the container, for example via the valve, the piston is driven towards the bottom of the container, taking with it a reinforcing element which was closing off the inlet orifice of the dispensing member. The reinforcing element is thus embedded in the mass forming by the piston.

More specifically, there is provided a method for packaging a product, for example a cosmetic product, inside a container whose bottom is closed and which has a free edge delimiting an opening, the method comprising introducing into the container through the opening a material in liquid form capable of setting, for example by polymerization, to form a piston which can move axially inside the container, bearing in leakproof fashion against the interior surface of the container; after the material has set in the bottom of the container, introducing the product into the container through the opening; mounting a valve in the opening; and introducing into the container, through a valve or some other equivalent member arranged in the bottom of the container, a propellant, for example in the form of a compressed or liquefied gas, capable of compressing the product via the piston.

Alternatively, the method may comprise introducing into the container through the opening a material in liquid form capable, of setting, for example by polymerization, to form a piston which can move axially inside the container, bearing in leakproof fashion against the interior surface of the container; mounting a valve in the opening; before the material sets, inverting the container so that its head is downmost so as to cause the liquid material to move away from the bottom; after the material forming the piston has set, introducing into the container, through a valve or some other equivalent member arranged in the bottom of the container, a propellant, for example in the form of a compressed or liquefied gas, capable of compressing the product via the piston; and introducing the product via the valve.

In yet another alternative embodiment of the present invention, there is provided a method for packaging a product, for example a cosmetic product, inside a container, a bottom of which is closed, permanently or temporarily, and a free edge of which delimits an opening. The method comprises introducing into the container through the opening a material in liquid form capable of setting, for example by polymerization, to form a piston which can move axially inside the container, bearing in leakproof fashion against the interior surface of the container; after the material has set in the bottom of the container, introducing the product into the container through the opening; and mounting a manually actuated pump in the opening.

According to one aspect of the invention, a dispenser for dispensing a product is provided. The dispenser comprises a container for storing the product, the container having an open end, a dispensing member mounted on the open end of the container, and a piston movable within the container, the piston separating a first volume of the container from a second volume of the container in a leakproof manner, wherein the first volume contains the product and is adjacent to the dispensing member and wherein the piston is formed by molding the piston inside the container.

According to another aspect of the invention, a method of forming a dispenser is provided. The method includes providing a container for storing a product, the container having an open end, and molding a piston inside the container such that the piston is movable in the container to separate a first volume of the container from a second volume of the container.

According to yet another aspect of the invention, a method for packaging a product in a dispenser comprising a container having an open end and a closed end is provided. The method comprises introducing a liquid material into the container through an opening in the open end, permitting the liquid material to solidify, and thereby form a piston configured to move axially within the container, the piston forming a leakproof seal with an interior surface of the container, adding a product to the container through the opening, and placing a propellant in the container through a filling element in the bottom of the container.

According to a further aspect of the invention, a method for packaging a product in a dispenser comprising a container having an open end and a closed end is provided. The method comprises introducing a liquid material into the container through an opening in the open end, the liquid material being capable of solidifying to form a piston configured to move axially within the container, the piston forming a leakproof seal with an interior surface of the container, mounting a valve on the open end, inverting the container with the valve, such that the valve is below the closed end of the container, before the liquid material is solidified in order to move the liquid material away from the closed end of the container, allowing the material to solidify and form the piston away from the closed end of the container, adding a propellant into said container through a filling element in the closed end of the container, the propellant applying pressure to the piston, and placing the product into the container through the valve.

Beside the structural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIGS. 1A–1G are cross-sectional views of the dispenser of the present invention during various stages in the production and filling of an aerosol dispenser according to a first embodiment of the invention;

Reference will now be made in detail to the present preferred embodiments of the invention, examples of which are illustrated in the accompanying drawings. Wherever possible, the same reference numbers are used in the drawings and the description to refer to the same or like parts.

Figure 1D:
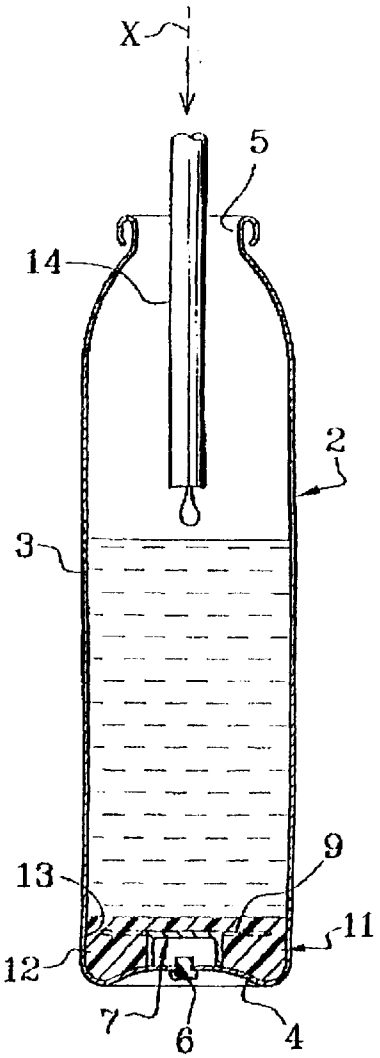
Figure 1C:
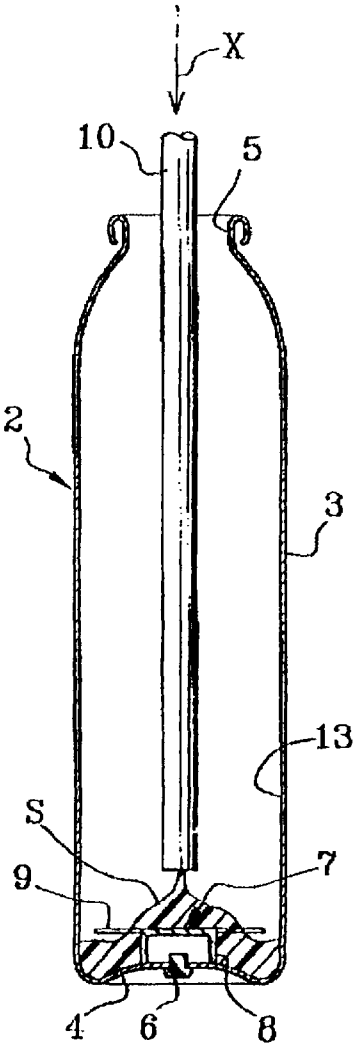
Figure 1B:
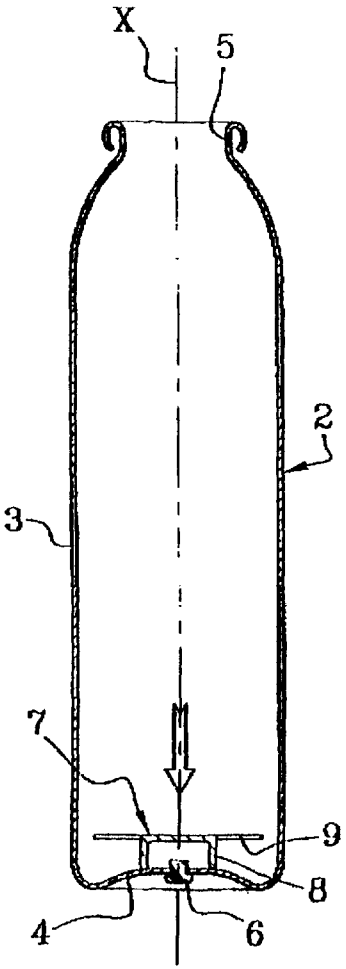
Figure 1A:
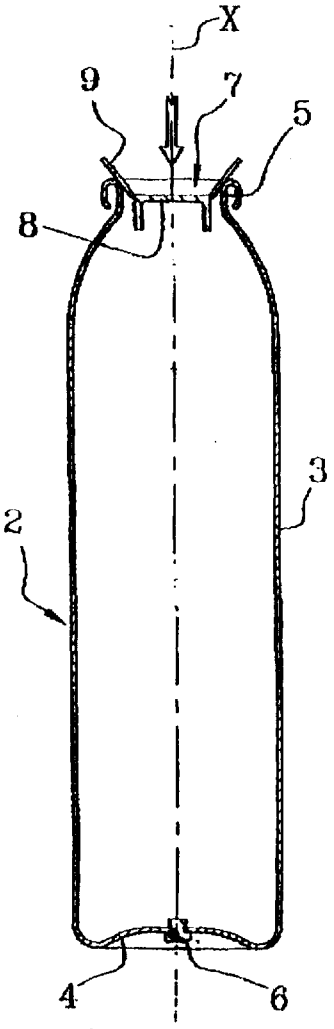
Figure 1G:
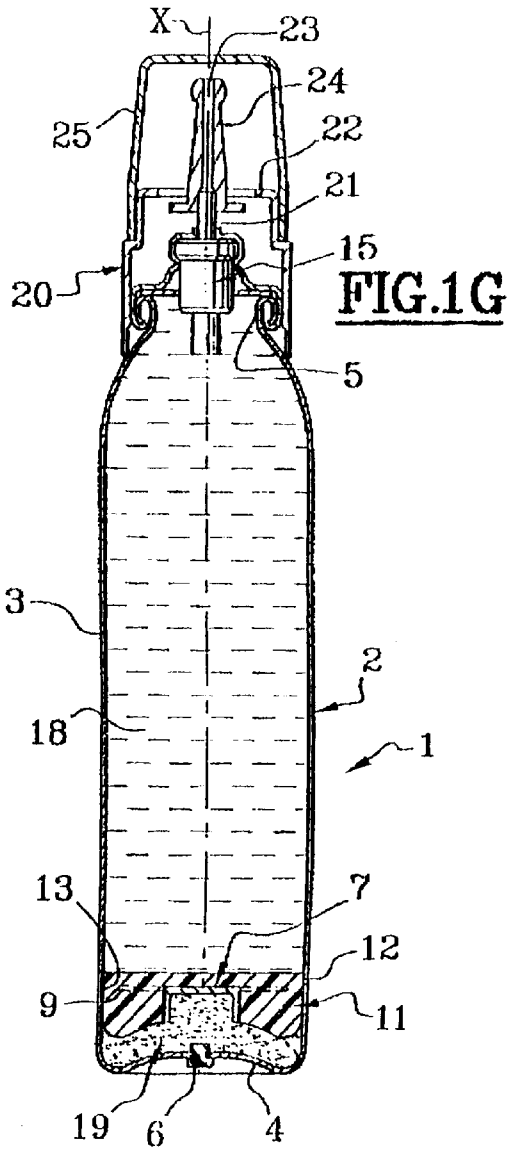

As embodied herein and shown in FIG. 1G, a dispenser for storing and dispensing a product is provided.

FIGS. 1A–1G illustrate a first method for assembling and filling an aerosol device according to the present invention. FIG. 1A depicts a tinplate container 2 comprising a cylindrical body 3 having a longitudinal axis X. One end of the body is closed by a bottom 4 and the other end forms a free edge shaped into a rolled neck delimiting an opening 5. At the opening 5, the container narrows to form a zone of smaller cross section in comparison to the normal cross section of the body 3 of the container 2. The bottom 4 of the container 2 is preferably pierced with an orifice in which there is a filling element, preferably in the form of an elastomer plug 6 intended, as will be seen in greater detail hereafter, to allow the corresponding volume of the container 2 to be filled with gas. A reinforcing element 7 made of rigid or semi-rigid thermoplastic, formed of a cup 8 having an open end which is intended to face the bottom 4 of the container, is introduced into the container 2 via the opening 5. An element of this kind is depicted in greater detail in FIG. 2.

Figure 2:
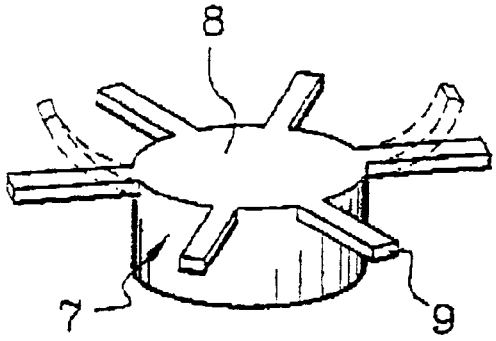
FIG. 2 is a isometric view of a reinforcing element used in the production of the dispenser in FIGS. 1A–1G.

The cup 8 illustrated in FIG. 2 has, near its closed end, a number of radial fins 9 which are flexible so that they can, in the manner of an umbrella, fold towards the axis of the cup 8. The diameter of the cup 8 is smaller than the inside diameter of the container at its narrowed portion. The maximum diameter of the reinforcing element 7 in the region of the radial fins 9 is slightly smaller than the inside diameter of the container in its largest cross section. Introducing the reinforcing element 7 into the container is made possible by the flexibility of the radial fins 9, which upon passage through the narrowed portion of the can 2 fold towards the axis of the cup 8, as depicted in dotted line in FIG. 2.

Once the narrowed portion has been negotiated, the fins revert to their position of rest, as the reinforcing element 7 gradually drops down into the bottom of the can 2, the cup 8 being arranged facing the plug 6. When the reinforcing element 7 is lying in the bottom 4 of the can 2, in the way depicted in FIG. 1B, the fins 9 extend in a plane which approximately passes through the plane of the bottom of the cup 8.

In FIG. 1C, a filling pipe 10 is used to deposit, in the bottom of the container 2, through the opening 5, a mixture S consisting of a vinyl-polydimethyl-siloxane and a polymerization catalyst and to do so over a thickness of about 15 mm. The thickness of deposited product is preferably sufficient to completely embed the reinforcing element 7.

After a setting time of about 5 to 10 minutes, the material deposited in the bottom of the can 2 solidifies and forms a piston 11 whose peripheral edge 12 bears against the interior lateral surface 13 of the container 2. At this instant, and as depicted in FIG. 1D, a filling pipe 14 is introduced into the container through the opening 5, and practically all of the volume above the piston 11 is filled with the product that is to be packaged, preferably a cosmetic product.

Figure 1F:
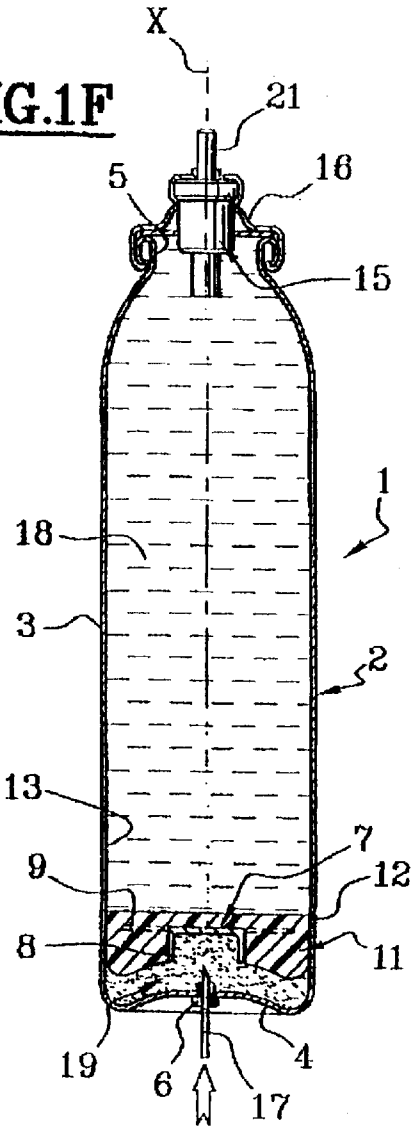
Figure 1E:
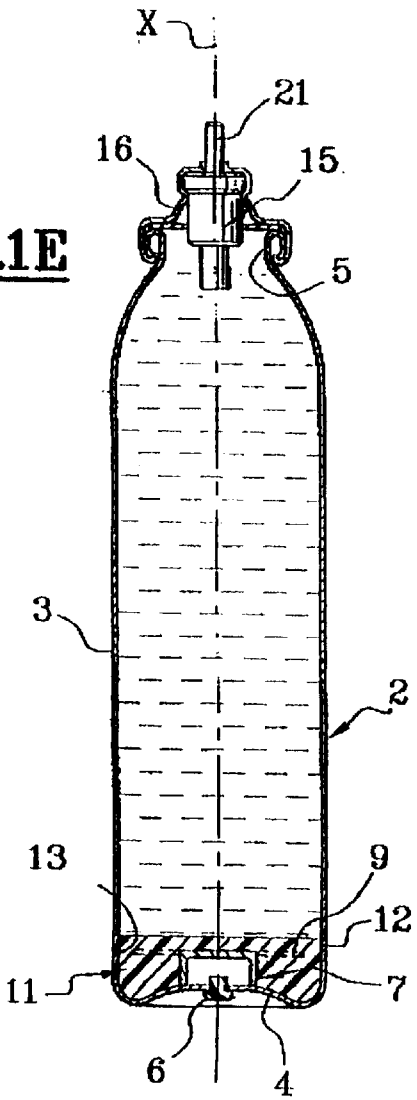

In FIG. 1E, a valve 15 borne by a valve-holder dish 16, and exhibiting a valve stem 21 is mounted in the opening 5, preferably by crimping.

In FIG. 1F, a hollow needle 17 communicating with a source of compressed air or some other propellant source, is introduced into the filling element (elastomer plug 6) and compressed air is introduced under the piston 11. While this is happening, the piston 11 rises slightly in the can (depending on the extent to which the can is full of product) and becomes axially compressed under the thrust of the gas. In this position, the piston 11 separates, in leakproof fashion, a first volume 18 adjacent to the valve 15 from a second volume 19 adjacent to the bottom 4 of the can 2. Under the effect of this axial compression, the force exerted radially by the piston 11 bearing against the interior surface 13 of the can increases appreciably, thus ensuring that the volumes 18 and 19 are separated in a fully leakproof fashion.

In FIG. 1G, a dispensing head 20 is mounted on the valve stem 21. Such a dispensing head includes an actuating surface 22 and a dispensing orifice 23, formed at the end of a dispensing adapter 24. A cap 25 is clipped removably over the dispensing head 20. The aerosol device 1 thus formed is ready for use.

Figure 3C:
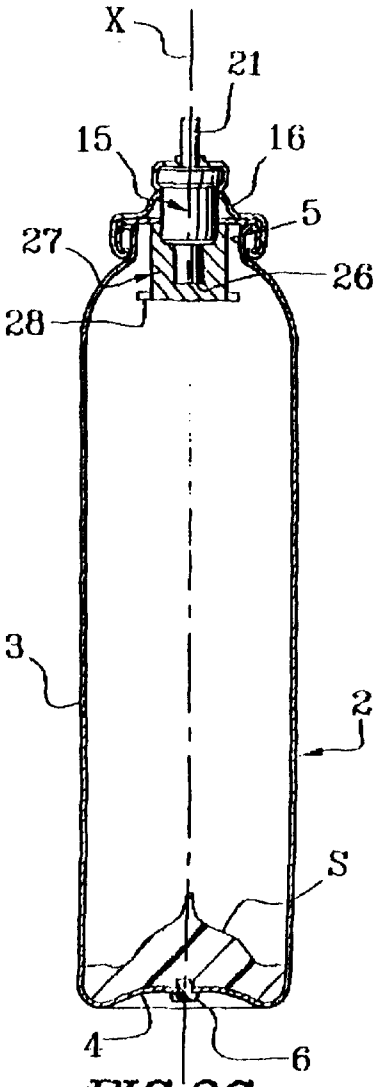
FIGS. 3A–3F are cross-sectional views of the dispenser of the present invention during various stages in the production and filling of an aerosol dispenser according to a second embodiment of the invention.
Figure 3B:
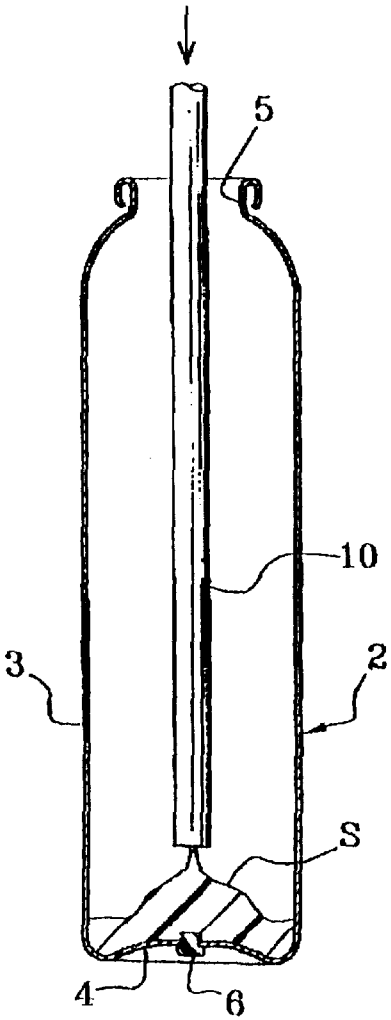
Figure 3A:
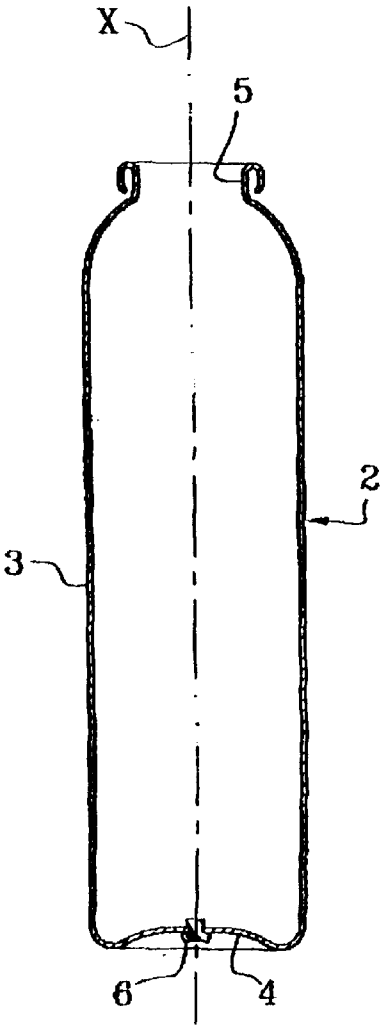

FIGS. 3A–3F illustrate an alternative form of the filling method described with reference to FIGS. 1A–1G. In FIG. 3A, the dispenser includes a container 2 similar to the one depicted and discussed with reference to FIG. 1A. In FIG. 3B, and in the same way as was illustrated in FIG. 1B, the silicone S intended to form the piston 11 is deposited in the bottom 4 of the can 2, using the filling pipe 10, via the opening 5.

Immediately afterwards, the valve 15 is crimped into the opening 5 (FIG. 3C). A reinforcing element, preferably a plug 27, which has a number of radial ribs 28, is mounted over the inlet orifice 26 of the valve 15 (arranged inside the container 2) in such a way that it automatically grips the inlet orifice of the valve lightly. In the region of the ribs 28, the plug has a diameter that is smaller than the inside diameter of the opening 5 of the container 2.

Figures 3D, 3E, 3F:
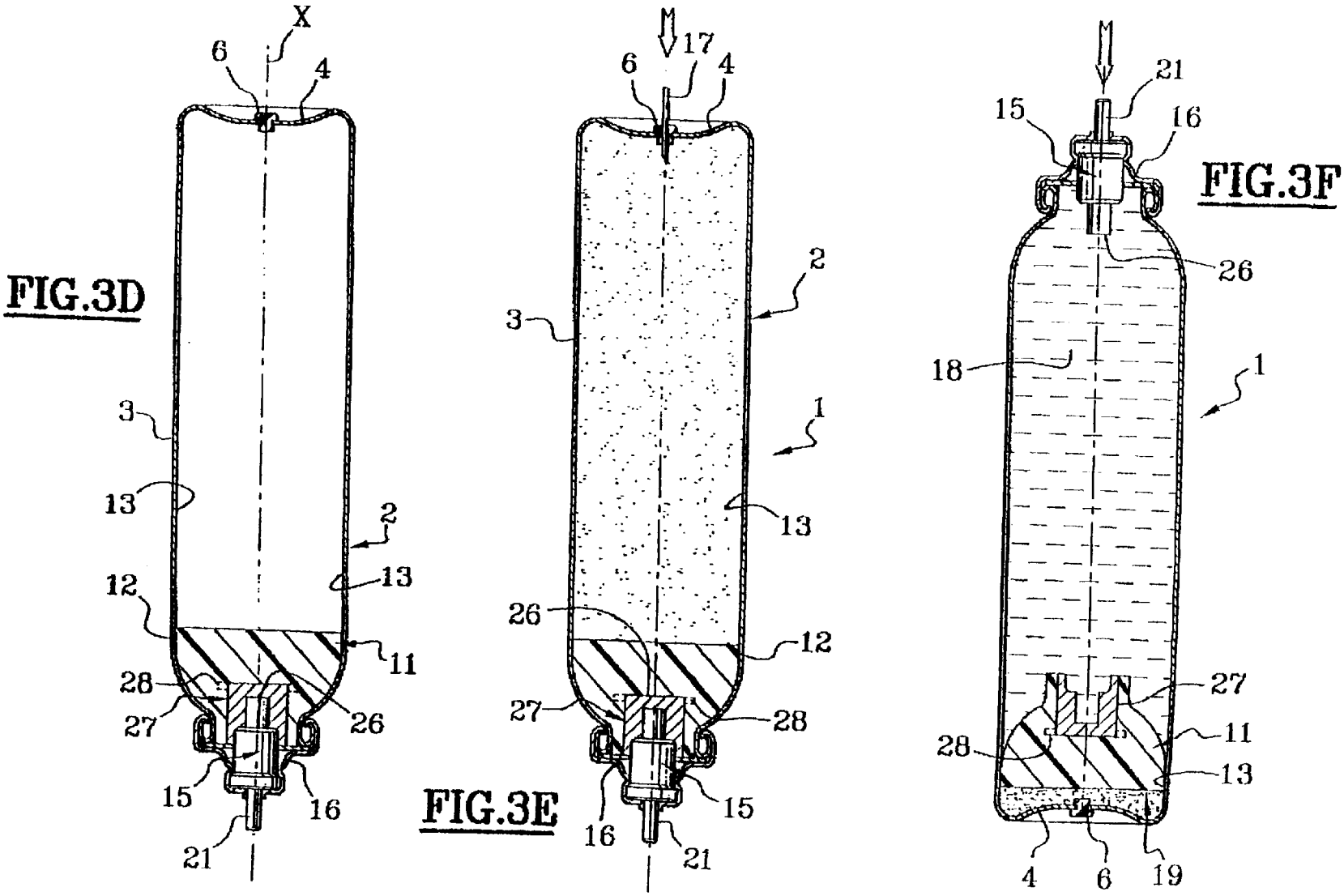

Before the material intended to form the piston has polymerized, the can 2 is inverted so that the head of the can having the valve 15 is lowermost, i.e., below the bottom 4 of the container 2 (FIG. 3D). Thus, the material intended to form the piston deposits itself in that end of the can that is adjacent to the valve 15. In this position, the valve 15 and the plug 27 and the ribs 28 are completely embedded in the silicone, which sets in this position to form the piston 11.

In FIG. 3E, the compressed air is introduced into the container 2 via the filling element, preferably elastomer plug 6, provided in the bottom 4 of the container 2. The compressed air is introduced in the same way as it was in the previous embodiment.

In FIG. 3F, the product is introduced into the container via the valve stem 21. While this is happening, the piston 11 is driven back towards the bottom 4 of the container 2, thereby taking with it the plug 27 which is embedded in its mass. In the same way as in the case of the previous embodiment, the piston 11 separates an upper volume 18 containing the product that is to be dispensed in pressurized form in leakproof fashion from a lower volume 19 containing the propellant. As is clear in this figure, that face of the piston 11 which faces towards the volume 18 has a profile which corresponds to the profile of the valve 15 inside the container 2 and to that of the upper part of the container, thus allowing the container 2 to be completely emptied. In the same way as for the embodiment of FIGS. 1A–1G, a dispensing head covered by a removable cap may be arranged on the valve stem.

Figure 4:
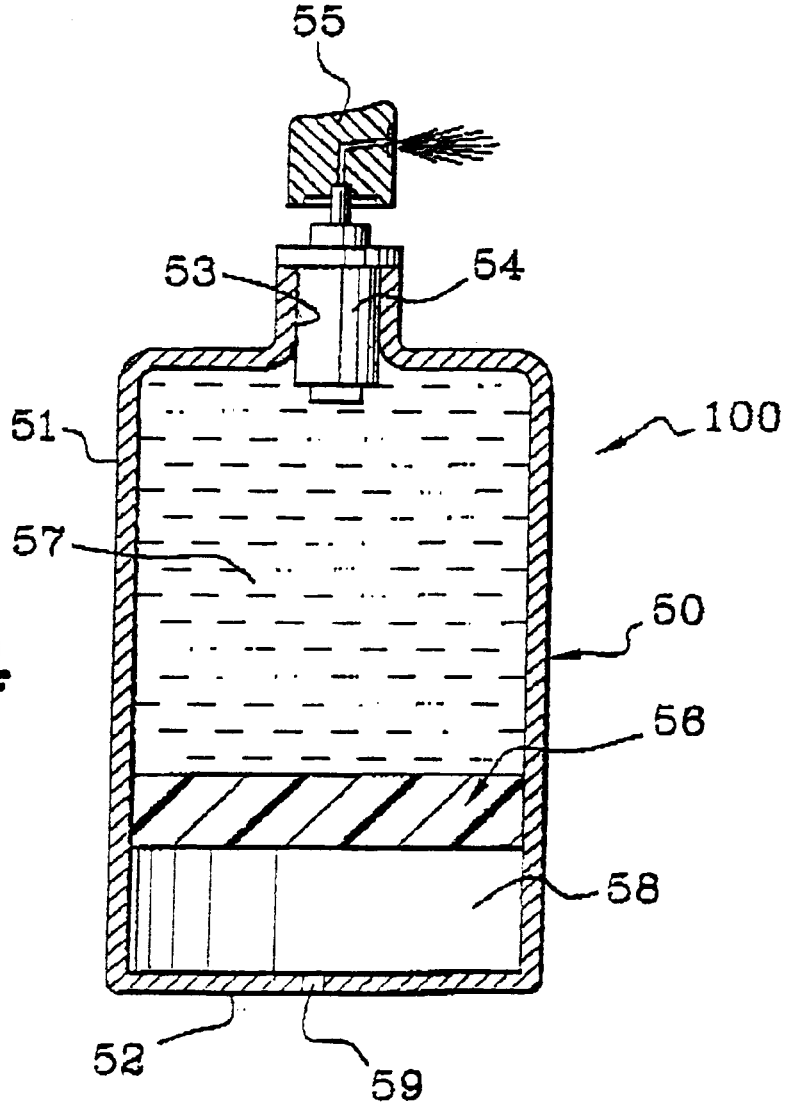
FIG. 4 is a cross-sectional view of an embodiment of a dispenser of the airless pump type with a follower piston according to the present invention.

FIG. 4 depicts a packaging assembly 100, of the type including a follower piston 56 in combination with a pump 54 which operates on the airless principle. Roughly speaking, an assembly of this kind comprises a plastic bottle 50 including a body 51 and one end of which is closed by a bottom 52. The other end has a free edge delimiting an opening 53 in which is mounted a pump 54 surmounted by a push button 55. Formed by molding in the container 50 is a piston 56 capable of separating a first volume 57 adjacent to the pump 54 and containing the product that is to be dispensed in leakproof fashion from a second volume 58 adjacent to the bottom 52 and placed at atmospheric pressure via an axial orifice 59. As the product is used, the ratio between the volumes 57 and 58 changes.

The piston 56 is mounted in the container 50 and product is filled in a similar way to the sequence illustrated with reference to FIGS. 1A–1E of the first embodiment. Just as was discussed with reference to FIG. 1A, an element similar to the reinforcing element 7 may, depending on the size of the orifice 59 and the viscosity of the silicone, be introduced into the bottom of the container 50 so as to prevent the silicone from closing off the orifice 59 and from becoming caught on it as it solidifies. An element of this kind may also be of use in stiffening the structure of the piston 56. Once the piston 56 has solidified, the product that is to be dispensed is introduced into the container via the opening 53 of the container. The pump 54 is then mounted in the opening 53. Finally, the push button 55 is mounted on the pump stem. The device is ready for use.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. A dispenser for dispensing a product, the dispenser comprising:

a container for storing the product, the container having an open end;

a dispensing member mounted on the open end of the container; and a piston movable within the container, the piston separating a first volume of the container from a second volume of the container in a leakproof manner, wherein the first volume contains the product and is adjacent to the dispensing member and wherein the piston is formed by molding the piston inside the container.

2. The dispenser of claim 1, wherein the dispensing member is chosen from a manually actuatable pump and a valve.

3. The dispenser of claim 1, wherein the second volume is adjacent to the first volume and contains a propellent for pressurizing the product in the first volume via the piston.

4. The dispenser of claim 1, wherein the second volume is adjacent a closed bottom of the container having a filling element for introducing a propellent into the second volume.

5. The dispenser of claim 4, wherein the filling element is a valve.

6. The dispenser of claim 4, wherein the propellent is chosen from a compressed gas and a liquified fluid.

7. The dispenser of claim 4, wherein the filling element includes a resealable plug configured to receive a hollow needle for supplying a propellent to the second volume, the plug being configured to reseal when the hollow needle is removed from the plug.

8. The dispenser of claim 7, wherein the plug comprises an elastomeric material.

9. The dispenser of claim 7, wherein said piston includes structure to prevent the hollow needle from being pushed into said piston.

10. The dispenser of claim 9, wherein the structure is a cup portion which provides a hollow space to receive the needle.

11. The dispenser of claim 1, wherein a body of the container comprises at least one of a thermoplastic material and a metal material.

12. The dispenser of claim 11, wherein the body of the container is formed of tin.

13. The dispenser of claim 11, wherein the body of the container is formed of aluminum.

14. The dispenser of claim 1, wherein the dispensing member is an airless pump, and wherein the piston forms a moveable bottom surface of the first volume, configured such that as the amount of product in the first volume decreases, the piston moves to decrease the size of the first volume proportional to the decrease in the volume of product.

15. The dispenser of claim 14, wherein the container is closed at a bottom end opposite to the airless pump, the bottom end having at least one orifice configured to allow air into the second volume of the container.

16. The dispenser of claim 1, wherein the piston is an elastically deformable structure in leakproof contact with an interior lateral surface of the container, and wherein the piston is formed by introducing a polymeric material into the container in liquid form, and solidifying the liquid while inside the container.

17. The dispenser of claim 16, wherein the liquid polymeric material is silicone.

18. The dispenser of claim 1, wherein the piston is configured to press against an interior lateral surface of the container.

19. The dispenser of claim 1, wherein the piston has a thickness ranging from 5 mm to 20 mm.

20. The dispenser of claim 1, wherein the piston is configured to press against an interior lateral surface of the container, and wherein a ratio of the axial distance which the piston presses on the container in a leakproof manner to the diameter of the piston at the point where it is in leakproof engagement with the interior lateral surface is at least 0.3.

21. The dispenser of claim 20, wherein the ratio ranges from 0.5 to 1.0.

22. The dispenser of claim 1, wherein the piston further includes a stiffening element.

23. The dispenser of claim 22, wherein the piston is configured to press against an interior lateral surface of the container, and wherein a ratio of the axial distance which the piston presses on the container in a leakproof manner to the diameter of the piston at the point where it is in leakproof engagement with the interior lateral surface is less than or equal to 1.0.

24. The dispenser of claim 23, wherein the ratio ranges from 0.3 to 0.6.

25. The dispenser of claim 1, further comprising a dispensing head mounted on said dispensing member, said dispensing head including at least one actuating surface for actuating the dispensing member and at least one dispensing orifice.

26. The dispenser of claim 25, further comprising a removable cap mounted on the dispensing head.

27. The dispenser of claim 1, wherein the product is a cosmetic product.

28. The dispenser of claim 1, wherein the piston is larger than an opening in the open end of the container so as to permanently remain in said container.

29. A method of forming a dispenser, comprising:

providing a container for storing a product, the container having an open end; and molding a piston inside the container such that the piston is movable in the container to separate a first volume of the container from a second volume of the container.

30. The method of claim 29, wherein the molding includes introducing a liquid polymer into said container via an opening in the open end of the container.

31. The method of claim 30, further including mounting a dispensing member on the open end of the container after the liquid polymer is introduced into the container.

32. The method of claim 31, further including inverting the container before polymerization of the liquid polymer occurs.

33. The method of claim 29, further comprising mounting a dispensing member on the open end of the container, and wherein the molding includes introducing a liquid polymer into said container via an open bottom of the container after said dispensing member has been mounted.

34. The method of claim 33, further comprising at least partially closing the open bottom of the container after the liquid polymer is introduced into the container.

35. The method of claim 33, wherein the closing includes closing the bottom of the container with a filling element.

36. The method of claim 29, wherein the molding includes introducing an element into the container and introducing a liquid polymer into said container via an opening in the open end of the container to cover the element, such that said element forms a part of the piston.

37. The method of claim 36, wherein said element is configured to close an inlet orifice of a dispensing member mounted on the open end of the container.

38. The method of claim 36, wherein said element is configured to cover a filling element in a bottom of said container.

39. A dispenser formed according to the method of claim 29.

40. A method for packaging a product in a dispenser comprising a container having an open end and a closed end, the method comprising:

introducing a liquid material into the container through an opening in the open end;

permitting the liquid material to solidify, and thereby form a piston configured to move axially within the container, the piston forming a leakproof seal with an interior surface of the container;

adding a product to the container through said opening; and placing a propellant in said container through a filling element in the bottom of the container.

41. The method of claim 40, wherein the adding includes introducing a cosmetic product into the container.

42. The method of claim 40, further comprising mounting a dispensing member on the open end of the container.

43. The method of claim 40, wherein the placing includes inserting a hollow needle connected to a source of the propellant into a resealable plug in the bottom of the, container.

44. The method of claim 40, wherein the step of introducing a liquid material into the container includes introducing liquid silicone into the container.

45. A dispenser including a product packaged in the dispenser according to the method of claim 40.

46. A method for packaging a product in a dispenser comprising a container having an open end and a closed end, the method comprising:

introducing a liquid material into the container through an opening in the open end, the liquid material being capable of solidifying to form a piston configured to move axially within the container, the piston forming a leakproof seal with an interior surface of the container;

mounting a valve on said open end;

inverting the container with the valve, such that the valve is below the closed end of the container, before the liquid material is solidified in order to move the liquid material away from the closed end of the container;

allowing the material to solidify and form the piston away from the closed end of the container;

adding a propellant into said container through a filling element in the closed end of the container, the propellant applying pressure to the piston; and placing the product into the container through said valve.

47. The method of claim 46, wherein the step of allowing includes forming an elastically deformable piston in leakproof contact with an interior lateral surface of the container.

48. The method of claim 46, wherein the liquid material is silicone.

49. The method of claim 46, wherein the product is a cosmetic product.

50. The method of claim 46, wherein the step of adding a propellant includes inserting a hollow needle connected to a source of the propellant into a resealable plug in the bottom of the container.

51. The method of claim 46, further comprising mounting a dispensing head on the valve.

52. A dispenser including a product packaged in the dispenser according to the method of claim 46.

* * * * *

UNITED STATES PATENT AND TRADEMARK OFFICE

CERTIFICATE OF CORRECTION

PATENT NO. : 6,230,762 B1
DATED : May 15, 2001
INVENTOR(S) : Gilles Baudin et al.

It is certified that error appears in the above-identified patent and that said Letters Patent is hereby corrected as shown below:

Column 11, claim 35,
Line 1, change "claim 33" to -- claim 34 --.

Column 11, claim 43,
Line 36, after "bottom of the", delete the comma.

Signed and Sealed this

Twenty-ninth Day of January, 2002

*Attest:*

*Attesting Officer*

JAMES E. ROGAN
*Director of the United States Patent and Trademark Office*